US007909086B2

(12) United States Patent
Tsukaguchi et al.

(10) Patent No.: US 7,909,086 B2
(45) Date of Patent: Mar. 22, 2011

(54) METHOD FOR CONTINUOUSLY CASTING BILLET WITH SMALL CROSS SECTION

(75) Inventors: Yuichi Tsukaguchi, Kashima (JP); Masayuki Kawamoto, Kashima (JP); Masahito Hanao, Kashima (JP); Atsushi Hirata, Wakayama (JP); Hiroshi Hayashi, Wakayama (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 12/579,471

(22) Filed: Oct. 15, 2009

(65) Prior Publication Data

US 2010/0025004 A1 Feb. 4, 2010

Related U.S. Application Data

(63) Continuation of application No. PCT/JP2007/064557, filed on Jul. 25, 2007.

(30) Foreign Application Priority Data

Jun. 28, 2007 (JP) ..... 2007-170547

(51) Int. Cl.
*B22D 11/00* (2006.01)

(52) U.S. Cl. ..... 164/478; 164/416; 164/418; 164/459; 164/453; 164/151.3; 164/449.1; 164/450.1; 164/454; 164/413; 164/455

(58) Field of Classification Search ..... 164/478, 164/416, 418, 459, 453, 151.1, 449.1, 450.1, 164/454, 413, 455
See application file for complete search history.

(56) References Cited

U.S. PATENT DOCUMENTS 5,033,534 A * 7/1991 Suzuki et al. ..... 164/468
6,386,271 B1 * 5/2002 Kawamoto et al. ..... 164/472

FOREIGN PATENT DOCUMENTS

| | | |
|---|---|---|
| JP | 62-61764 | 3/1987 |
| JP | 62-263855 | 11/1987 |
| JP | 2-15856 | 1/1990 |
| JP | 5-49156 | 6/1993 |
| JP | 2856068 | 11/1998 |
| JP | 2001-62550 | 3/2001 |
| JP | 3401785 | 2/2003 |
| JP | 3405490 | 3/2003 |
| JP | 2005-224847 | 8/2005 |
| JP | 2006-95545 | 4/2006 |
| RU | 2150347 | 6/2000 |
| RU | 2270074 | 2/2006 |

* cited by examiner

*Primary Examiner* — Jessica L Ward
*Assistant Examiner* — Erin B Saad
(74) *Attorney, Agent, or Firm* — Clark & Brody

(57) ABSTRACT

Continuously casting a billet with a small cross section by pouring molten steel into a mold using a cylindrical immersion nozzle is characterized by measuring the molten steel level in the mold using an eddy current sensor. The level is controlled based on the thus-measured value, motion of steel in the mold is adjusted by electromagnetic stirring, a cooling zone during the final period of solidification is disposed within a certain region ranging from the meniscus to the specific site, and casting speed is adjusted so that the region in which the solid phase ratio at the billet center is 0.3-0.99 may be included in the cooling zone during the final period of solidification. The secondary cooling water amount and the billet surface temperature at the entrance to the cooling zone the density of cooling water in the cooling zone during the final period of solidification are optimized.

11 Claims, 1 Drawing Sheet

METHOD FOR CONTINUOUSLY CASTING BILLET WITH SMALL CROSS SECTION

This application is a continuation of International Patent Application No. PCT/JP2007/064557, filed Jul. 25, 2007. This PCT application was not in English as published under PCT Article 21(2).

TECHNICAL FIELD

The present invention relates to a method for continuously casting a cast billet with a small cross section (hereinafter also referred to merely as "billet" for short) from any of various steel grades such as carbon steel, low alloy steel, high alloy steel and stainless steel while reducing the possibility of center porosity formation along the billet center and improving the inner quality inside the billet.

BACKGROUND ART

In a process such as Ugine-Sejournet extrusion process or Mannesmann tube making process via a rolling or forging process, for manufacturing a seamless steel pipe from a billet, produced by continuous casting as a raw material, for instance, the inner part of the billet of use constitutes the inner surface of the pipe. Therefore, the billet for manufacture of a seamless pipe is imperatively required to be homogeneous in quality not only on the outer surface but also on the inside and, therefore, the quality control of the inner part of the billet is important. If center porosity occurs in a billet obtained by continuous casting and the extent thereof is above a tolerance limit, the seamless steel pipe produced from the billet often have inner surface defects, which are likely to be rejected from the quality viewpoint.

Therefore, a secondary cooling method utilizing thermal shrinkage during billet cooling has been proposed for the purpose of reducing the possibility of center porosity occurring in the billet in a continuous billet casting process.

For example, in Japanese Patent Application Publication S62-61764, there is disclosed a method which comprises subjecting the billet surface to forced water cooling, following the direction of casting, in a region ranging from the site at 2-15 m in front of a liquid core crater end inside the billet in the casting direction to the liquid core crater end to an extent that the shrinkage thereof during solidification at least comes to the amount of shrinkage in volume to cause shrinkage of the billet's solidified shell and thus reduce the billet cross section, thereby reducing the extent of center segregation.

Further, in Japanese Patent Application Publication S62-263855, there is disclosed a method which comprises successively lowering the billet surface temperature, following the direction of casting, in an area spanning from the site at 2-15 m in front of a liquid core crater end inside the billet in the casting direction to the liquid core crater end, to a temperature not less than the $A_3$ transformation temperature of the steel or the starting temperature $T_A$ of Acm transformation and not more than the effective billet surface temperature $T_v$ given by $Ta+(T_N-Ta)\times 0.3=T_v$ in response to the progress of solidification of the billet liquid core to cause the billet solidified shell to shrink and thus reduce the billet cross section and thereby reduce the possibility of center porosity formation. In the above equation, $T_N$ is the billet surface temperature resulting from open air cooling after leaving the pinch roll unit and Ta is the billet surface temperature at which such average cooling of the solidified shell that is necessary for compensating the amount of shrinkage during solidification is attained.

Further, Japanese Patent Application Publication H02-15856 discloses a method which comprises subjecting the billet to forced cooling, while the core of the billet during continuous casting is in a soft solidified phase condition, so that an effect such that the soft core is always compressed by the already completely solidified shell around the core owing to the difference in thermal shrinkage between the core and the shell, to thereby reduce the possibility of center porosity formation.

However, the methods disclosed in Japanese Patent Application Publication S62-61764, Japanese Patent Application Publication S62-263855 and Japanese Patent Application Publication H02-15856, among others, have the following problems. For example, (1) when forced cooling is carried out on the side excessively upstream relative to the point of final solidification, no more temperature allowance for cooling remains at a time when the possibility of center porosity formation becomes really high and the cooling effect decreases; (2) if cooling is stopped when the core of the billet is not yet in a solidified state, return of heat causes increased center porosity or internal cracking; (3) the ranges of proper conditions for obtaining the effects of reducing center porosity and center segregation are very narrow, so that extraneous disturbances, for instance, readily cause the actual production conditions to deviate from the proper ranges.

Previously, the present inventors proposed the methods disclosed in Japanese Patents No. 2,856,068, No. 3,405,490 and No. 3,401,785 and summarized below as technologies of improving the methods disclosed in the above-cited Japanese Patent Application Publications S62-61764, S62-263855 and H02-15856.

The method proposed in Japanese Patent No. 2,856,068 is a method of cooling which comprises starting billet surface cooling at a specified density of cooling water at the time of arrival of the solid phase ratio in the central portion of the billet at 0.1-0.3 and continuing water cooling at that density of cooling water until arrival of the solid phase ratio in the central portion of the billet at a level not less than 0.8. The method proposed in Japanese Patent No. 3,405,490 is a method for improving the inner quality which comprises starting surface cooling of a billet having a diameter or thickness not exceeding a specified value with water in a specific amount within a specified range at the time of arrival of the solid phase ratio in the central portion of the billet at 0.2-0.8 and continuing water cooling with the above specific amount of water until complete solidification. The method proposed in Japanese Patent No. 3,401,785 is a method of cooling which comprises adjusting the density of billet surface cooling water to a value within a specified range from a site 0.1-2.0 m in from of the liquid core crater end in the casting direction until arrival of the solid phase ratio in the central portion of the billet at a level not less than 0.99, while increasing the density of cooling water toward the downstream side.

The present inventors have thus brought about marked improvements with respect to the problems (1)-(3) mentioned above by putting the technologies disclosed in the above-mentioned Japanese Patents No. 2,856,068, No. 3,405,490 and No. 3,401,785 to practical use. For obtaining the inner quality improving effects more stably and more reliably, however, there is still room for improvement from the technological viewpoint.

DISCLOSURE OF INVENTION

The present invention, which has been made in view of the problems discussed above, has its object to provide a method of continuously casting a billet with a small cross section from any of various steel grades such as carbon steel, low alloy steel, high alloy steel and stainless steel wherein the center porosity formation at the billet center can be reduced stably and reliably and the inner quality improving effect can be exhibited.

The present inventors have put the technologies described in the above-mentioned Japanese Patents No. 2,856,068, No. 3,405,490 and No. 3,401,785, among others, to practical use and have accumulated a number of application cases. At the same time, they have pushed ahead with their research and development works to establish a method of continuously casting a billet with a small cross section wherein the inner quality improving effect can be produced more stably and more reliably. As a result, they obtained the following findings (a)-(h), which have now led to completion of the present invention.

(a) The method of the invention which utilizes the thermal shrinkage resulting from billet surface cooling to cause compression of the billet is highly effective in continuous casting of a small cross section billet whose cross sectional area is not more than 500 $cm^2$. Since, in the above-mentioned continuous casting, a mold with a small cross section is used and an eddy current sensor for melt level control in a mold is used, it is necessary to use a cylindrical immersion nozzle with a single port as the nozzle for pouring molten steel into the mold.

(b) By adjusting the motion of the molten steel in the mold by electromagnetic stirring, it becomes possible to increase the formation ratio of equiaxial crystals in the central portion of the billet and inhibit the development of porosity at the billet center and further allow the solidified shell to grow uniformly. For securing the equiaxial crystal formation promoting effect by the above-mentioned electromagnetic stirring, it is necessary that the inner diameter of the single port of the immersion nozzle mentioned above under (a) be not less than 40 mmϕ so that the outlet flow velocity of molten steel may be suppressed.

(c) For maintaining the solidified shell growth stably and suppressing the variation in solid phase ratio at the billet center in the cooling zone during the final period of solidification, high precision molten steel level control in the mold is necessary and, for molten steel level measurements, the use of an eddy current sensor for molten steel level control in a mold is appropriate, as mentioned above under (a). With other molten steel level sensors of the γ ray type, thermocouple type and so forth, the molten steel level detecting sensitivity is low and those high precision molten steel level measurements which are required in the practice of the invention can never be realized by those.

(d) For securing the productivity in continuous casting and attaining stable operations, it is necessary to provide a cooling zone during the final period of solidification in the region from the meniscus of molten steel in the mold to a distance of 15-45 m in the direction of casting. For sufficient billet cooling and for avoiding useless cooling and preventing billet deformations due to super cooling, it is necessary that the cooling zone during the final period of solidification be a continuous cooling zone having a length of 3-8 m.

(e) It is appropriate that the casting speed be adjusted so that the region in which the solid phase ratio at the billet center is 0.3-0.99 be included in the cooling zone during the final period of solidification. The reason is that since the porosity at the billet center has the initiation point of occurrence in the region in which the solid phase ratio at the billet center is 0.3-0.99 and grows in that region, it is effective in preventing the occurrence of porosity at the billet center to carry out terminal cooling in the above-mentioned solid phase ratio range.

(f) It is necessary that the specific amount of cooling water in the secondary billet cooling zone be 0.1-0.8 liter (L)/kg-steel and that the billet surface temperature at the entrance to the cooling zone during the final period of solidification be 900-1200° C. When the specific amount of water in the secondary cooling zone is smaller, the billet bulges due to the hydrostatic pressure of molten steel and it becomes difficult to predict or estimate the solid phase ratio at the billet center in the cooling zone during the final period of solidification. When, on the contrary, the specific amount of water is excessive, cooling becomes no more uniform and fluctuations in solidified shell thickness readily occur, with the result that the solid phase ratio at the billet center in the cooling zone during the final period of solidification becomes difficult to predict.

When the billet surface temperature at the entrance to the cooling zone during the final period of solidification is lower than 900° C., the phase transformation from γ phase to a phase occurs and the billet surface expands, so that the porosity reducing effect is readily lessened. When, conversely, the billet surface temperature at the entrance to the cooling zone during the final period of solidification is excessively high, cooling becomes no more uniform and the porosity reducing effect becomes unstable.

(g) It is necessary that the density of cooling water on the billet surface in the cooling zone during the final period of solidification be 20-300 L/(min·$m^2$). This is because when the density of cooling water is lower, the cooling effect is too weak for the effects of the invention to be satisfactorily produced and, when the density of cooling water is in excess of 300 L/(min·$m^2$), the billet surface temperature is lowered to an excessive extent and the billet surface expands due to the phase transformation from γ phase to a phase and thus the porosity reducing effect is readily lessened.

(h) The cutting of the billet is to be carried out at least 1 m downstream from the exit of the cooling zone during the final period of solidification. This is because when the billet is cut just after the exit from the cooling zone during the final period of solidification, the billet after cutting is readily bent due to the fact that fluctuations in billet surface temperature as caused by uneven cooling during the final period of solidification have not yet been reduced.

The gist of the present invention, which has been completed based on the above findings, consists in the following continuous casting methods specified below under (1)-(5).

(1) A method for continuously casting a billet with a small cross section in which the billet has a cross sectional area of not more than 500 $cm^2$ and a cylindrical immersion nozzle with a single port of not less than 40 mm in inside diameter is used for pouring a molten steel into a mold, characterized in that: a surface level of molten steel is measured using an eddy current sensor and the molten steel level in a mold is controlled based on the thus-measured value, and motion of molten steel in the mold is adjusted by providing electromagnetic stirring; a cooling zone during the final period of solidification, which is 3-8 m in length and continuous in the direction of casting, is provided in the region from the meniscus of molten steel in the mold to an area that is 15-45 m away therefrom in the direction of casting, and a casting speed is adjusted so that the region in which the solid phase ratio at the billet center is 0.3-0.99 may be included in the cooling zone during the final period of solidification; the billet is cooled in a secondary cooling zone, located on the side upstream (in the direction of casting) relative to the cooling zone during the final period of solidification, with cooling water in a specific amount of 0.1-0.8 liter (L)/kg-steel to thereby adjust the billet surface temperature at the entrance to the cooling zone during the final period of solidification to 900-1200° C.; the billet is cooled in the cooling zone during the final period of solidification at a density of cooling water on the billet surface of 20-300 liters (L)/(min·m$^2$); and the billet is cut at a site of at least 1 m downstream (in the direction of casting) relative to the exit of the cooling zone during the final period of solidification (hereinafter sometimes referred to also as "a first aspect of the invention").

(2) The continuous casting method as described above under (1), characterized in that the fluctuations in the surface level of molten steel in the mold are controlled within ±10 mm (hereinafter sometimes referred to also as "a second aspect of the invention").

(3) The continuous casting method as described above under (1) or (2), characterized in that the electromagnetic stirring is carried out while the molten steel in the mold is rotated in a horizontal plane and the maximum value of a tangential flow velocity of molten steel is adjusted within the range of 0.2-0.8 m/s (hereinafter sometimes referred to also as "a third aspect of the invention").

(4) The continuous casting method as described above under any of (1)-(3), characterized in that the adjustment of the casting speed is carried out in response to significant changes in the contents in molten steel of at least three elements selected from among C, Si, Mn, P, S, Cr, Mo and Ni and a significant change in casting temperature (hereinafter sometimes referred to also as "a fourth aspect of the invention").

(5) The continuous casting method as described above under any of (1)-(4), characterized in that the secondary cooling of the billet is terminated at a site of at least 2 m upstream (in the direction of casting) relative to the entrance to the cooling zone during the final period of solidification (hereinafter sometimes referred to also as "a fifth aspect of the invention").

The "eddy current sensor for molten steel level control in mold" so referred to herein is an eddy current distance sensor in wide use as used for the measurement of the molten steel surface level of molten steel and is molten steel level sensor constituted of a transmitting coil and a receiving coil. This type of molten steel level sensor is characterized, among others, in that the precision in measurement of the molten steel level is very high.

The "secondary cooling zone" means a cooling zone located downstream relative to the mold exit and directly cooling the billet surface by spraying.

The "solid phase ratio at the billet center" means the fraction of the solid phase region relative to the whole region occupied by the solid phase and liquid phase in the central portion of the billet.

The term "significant change" means such an extent of change in an operational factor exerting an influence on the billet solidification rate, for example a steel composition or casting temperature, which is sufficient for that influence to arrive at or exceed a certain prescribed level. The value thereof is determined based on the operational experiences and actual operation results. For the contents of such elements as C, Si, Mn, P, S, Cr, Mo and Ni, it is about ±0.001 to ±0.01% by mass and, in the case of casting temperature, it is about ±2 to ±5° C. How to reflect the change or changes on the casting speed will be described later herein under 2-4.

BEST MODES FOR CARRYING OUT THE INVENTION

1. Basic Constitution of the Invention

Figure 1:
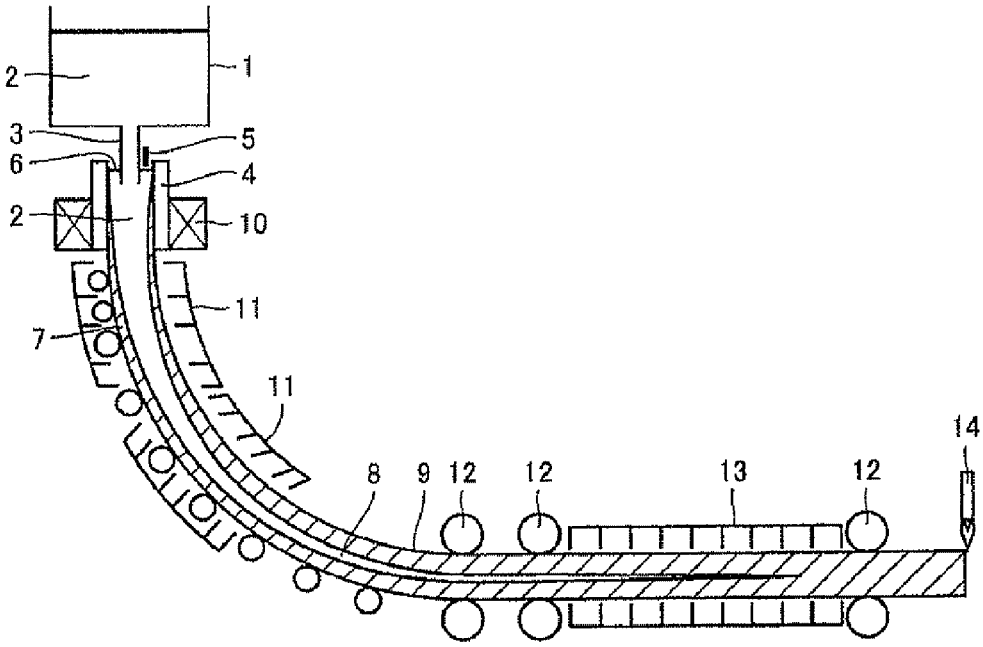
FIG. 1 is a schematic diagram illustrating the continuous casting method of the invention for casting a billet with a small cross section.

As mentioned hereinabove, the invention consists in a method for continuously casting a billet with a small cross section in which the billet has a cross sectional area of not more than 500 cm$^2$ and a cylindrical immersion nozzle with a single port of not less than 40 mm in inside diameter is used for pouring a molten steel into a mold, characterized in that: a surface level of molten steel is measured using an eddy current sensor for molten steel level control in a mold and the molten steel level is controlled based on the thus-measured value, and motion of molten steel in the mold is adjusted by providing electromagnetic stirring; a cooling zone during the final period of solidification, which is 3-8 m in length and continuous in the direction of casting, is provided in the region ranging from the meniscus of molten steel in the mold to an area that is 15-45 m away therefrom in the direction of casting, and a casting speed is adjusted so that the region in which the solid phase ratio at the billet center is 0.3-0.99 may be included in the cooling zone during the final period of solidification; the billet is cooled in a secondary cooling zone, located on the side upstream relative to the cooling zone during the final period of solidification, with cooling water in a specific amount of 0.1-0.8 liter (L)/kg-steel to thereby adjust the billet surface temperature at the entrance to the cooling zone during the final period of solidification to 900-1200° C., that the billet is cooled in the cooling zone during the final period of solidification with a cooling water at a density of 20-300 liters (L)/(min·m$^2$) on the billet surface; and the billet is cut at a site of at least 1 m downstream relative to the exit of the cooling zone during the final period of solidification. In the following, the subject matter of the invention is described in further detail.

FIG. 1 is a schematic depiction of the vertical cross section for illustrating the continuous casting method of the invention for casting a billet with a small cross section. The molten steel 2 contained in a tundish 1 is poured, through an immersion nozzle 3, into a mold 4 and cooled with a cooling water within the mold and with a secondary spray water sprayed from a cooling apparatus 11 (a group of spray nozzles) in a secondary cooling zone located below the mold to form a billet 9 while forming a solidified shell 7. Here, the surface level (height) of the molten steel 6 in the mold 4 is measured by means of an eddy current sensor 5 for melt level control and the molten steel level is controlled based on the measured value and, at the same time, the molten steel in the mold is provided with electromagnetic stirring by an electromagnetic stirring apparatus 10 and the molten steel motion is thereby controlled.

The billet 9 containing the unsolidified molten steel 8 in the central portion thereof is withdrawn in the direction toward the right in the FIGURE by a pinch roll unit 12 and, after complete solidification as a result of cooling with water sprayed from a cooling apparatus 13 in a cooling zone during the final period of solidification, the billet is cut by a billet cutting device (cutting torch) 14.

2. Grounds for Specifying Constitutional Elements and Preferred Modes of Embodiment 2-1. First Aspect of the Invention 1) Cross Sectional Area of not More than 500 $Cm^2$ It is necessary that the cross sectional area of the billet be not more than 500 $cm^2$. When the cross sectional area is in excess of 500 $cm^2$, it becomes difficult for the effect of the invention, namely the effect of compressing the billet inside utilizing the thermal shrinkage during cooling of the billet surface, to be produced. The lower limit value to the cross sectional area is not particularly specified herein. In the light of the lower limit to the cross sectional area in ordinary continuous casting, however, the cross sectional rea preferably be about 150 $cm^2$ or more.

2) Use of a Cylindrical Immersion Nozzle with a Single Port of not Less than 40 mm in Inner Diameter The reason why a cylindrical immersion nozzle with a single port is used is that when molten steel is poured into a continuous casting mold having such a small cross section as mentioned above, it is difficult to use an immersion nozzle having a plurality of outlet ports and, for using an eddy current sensor for molten steel level control in mold, which is described later herein, it is necessary to use the above-specified immersion nozzle. Further, the reason why the inner diameter of the single port should be not less than 40 mm is that when that inner diameter is less than 40 mm, the outlet flow velocity becomes excessively high and the after-mentioned effect of electromagnetic stirring to promote equiaxial crystal formation becomes lessened. The upper limit to the inner diameter of the single port is not particularly specified. In view of the lower limit to the inner diameter in ordinary continuous casting of a billet with a small cross section, however, the inner diameter is preferably not more than about 80 mm.

3) Use of an Eddy Current Sensor for Molten Steel Level Control in a Mold

The reason why an eddy current sensor of molten steel level control in a mold is used is as follows. For allowing the solidified shell to grow stably and suppressing the fluctuation in solid phase ratio at the billet center in the cooling zone during the final period of solidification to thereby produce the effects of the invention in a stable manner, it is necessary to use an eddy current sensor for molten steel level control in a mold by which high precision measurements can be made. With other melt level sensors of the γ ray type, thermocouple type and so forth, the molten steel level detecting sensitivity is low and those high precision melt level measurements which are required in the practice of the invention can never be realized.

4) Electromagnetic Stirring of Molten Steel in a Mold

The following two are the reasons why the motion of molten steel within the mold is adjusted by electromagnetic stirring. The first reason is that the effect of inhibiting the development of center porosity at the billet center can be produced reliably by adjusting the rate of flow of molten steel by providing electromagnetic stirring to thereby promote the formation of equiaxial crystals at the billet center and thus increase the equiaxial crystal ratio. The second reason is that the effect of allowing uniform growth of the solidified shell can be obtained by adjusting the motion of molten steel by providing electromagnetic stirring.

5) Disposition of a 3 to 8 m Long Cooling Zone During the Final Period of Solidification in the Region from the Meniscus of Molten Steel to a Site of 15-45 m Away Therefrom The reason why a cooling zone during the final period of solidification is disposed in the region ranging from the meniscus to a site of 15-45 m away therefrom is as follows. When the distance from the meniscus to the cooling zone during the final period of solidification is shorter than 15 m, the casting speed becomes excessively low and the productivity of continuous casting decreases and, when the distance from the meniscus to the cooling zone during the final period of solidification is longer than 45 m, the casting speed becomes excessively high and it becomes difficult to carry out stable casting operations. Here, the casting speed range is not particularly specified but it is generally preferred from the viewpoint of the improved productivity and stable operation that the operation be carried out within the range of about 1.5-4.0 m/min.

The reason why the length of the cooling zone during the final period of solidification should be not shorter than 3 m is as follows. When the length in question is shorter than 3 m, no sufficient billet cooling can be attained. The reason why the length of the cooling zone during the final period of solidification should be not longer than 8 m is that a length exceeding 8 m not only makes the cooling zone unnecessarily long but also allows billet bending to occur as a result of supercooling.

6) Adjustment of the Casting Speed so that the Region in which the Solid Phase Ratio at the Billet Center is 0.3-0.99 May be Included in the Cooling Zone During the Final Period of Solidification The reason why the casting speed is adjusted so that the region in which the solid phase ratio at the billet center is 0.3-0.99 may be included in the cooling zone during the final period of solidification is as follows. The center porosity at the billet center has the initiation point of occurrence in the region in which the solid phase ratio at the billet center is 0.3-0.99 and grows in that region. Therefore, it is effective in preventing the occurrence of center porosity at the billet center to carry out the cooling during the final period of solidification in the period of solidification in which the solid phase ratio is within the above range.

7) Specific Amount of Cooling Water of 0.1-0.8 L/Kg-Steel in the Secondary Billet Cooling Zone and Billet Surface Temperature of 900-1200° C. at the Entrance to the Cooling Zone During the Final Period of Solidification The reason why the specific amount of cooling water in the secondary billet cooling zone should be 0.1-0.8 L/kg-steel is as follows. When the specific amount of water in the secondary cooling zone is less than 0.1 L/kg-steel, the billet bulges due to the hydrostatic pressure of molten steel and the cross sectional area of the billet readily enlarges and, therefore, it becomes difficult to predict or estimate the solid phase ratio at the billet center in the cooling zone during the final period of solidification. When, on the contrary, the specific amount of secondary cooling water is in excess of 0.8 L/kg-steel, cooling becomes no more uniform and fluctuations in solidified shell thickness readily occur, with the result that the solid phase ratio at the billet center in the cooling zone during the final period of solidification becomes difficult to predict.

The reason why the billet surface temperature at the entrance to the cooling zone during the final period of solidification should be 900-1200° C. is as follows. When the billet surface temperature at the entrance to the cooling zone during the final period of solidification is less than 900° C., the billet surface temperature becomes excessively lowered in the cooling zone during the final period of solidification and the phase transformation from γ phase to a phase occurs and the billet surface expands, so that the effect of reducing the occurrence of center porosity is readily lessened. When, conversely, the billet surface temperature at the entrance to the cooling zone during the final period of solidification is higher, namely in excess of 1200° C., the cooling in the cooling zone during the final period of solidification becomes no more uniform and uneven cooling readily occurs and the effect of reducing the occurrence of porosity becomes unstable.

8) Cooling Water with a Density of 20-300 L/(Min·m$^2$) on the Billet Surface in the Cooling Zone During the Final Period of Solidification The reason why the density of cooling water on the billet surface in the cooling zone during the final period of solidification should be 20-300 L/(min·m$^2$) is as follows. When the density of cooling water is less than 300 L/(min·m$^2$), the cooling effect is too weak for the effects of the invention to be fully produced and, when the density of cooling water is in excess of 300 L/(min·m$^2$), the billet surface temperature is lowered to an excessive extent, the phase transformation from γ phase to a phase occurs and the billet surface expands and thus the center porosity reducing effect is readily lessened.

9) Billet Cutting at a Site of at Least 1 m Downstream Relative to the Exit of the Cooling Zone During the Final Period of Solidification The reason why the billet cutting is carried out at a site of at least 1 m downstream relative to the exit of the cooling zone during the final period of solidification is as follows. When the billet is cut at a site within 1 m just after the exit of the cooling zone during the final period of solidification, the billet after cutting is readily bent due to the fact that the unevenness in billet surface temperature as caused by uneven cooling during the final period of solidification has not yet been reduced by thermal diffusion. Thus, for preventing billet bending after cutting, it is necessary to cut the billet at a site of at least 1 m downstream relative to the exit of the cooling zone during the final period of solidification. It is preferable and desirable that the billet cutting be completed at a site of at least 3 m downstream relative to the exit of the cooling zone during the final period of solidification. This is because the uneven billet surface temperature distribution resulting from uneven cooling in the cooling zone during the final period of solidification is then rendered sufficiently even and uniform owing to thermal diffusion and the billet is still more prevented from bending.

2-2 Second Aspect of the Invention

In the second aspect thereof, the invention is directed to a continuous casting method according to the first aspect of the invention, characterized in that the fluctuations in surface level of molten steel in the mold are controlled within ±10 mm, as described hereinabove.

The reason why the fluctuations in surface level of molten steel in the mold are preferably controlled within ±10 mm is that when the fluctuations in surface level of molten steel in the mold become large in excess of ±10 mm, the growth of the solidified shell becomes unstable. If the growth of the solidified shell becomes unstable, the fluctuations in solid phase ratio at the billet center in the cooling zone during the final period of solidification will increase and the effects of the invention, namely the effect of stably and reliably reducing the occurrence of center porosity and the effect of improving the inner quality of the billet will be no longer satisfactorily achieved.

For suppressing the amounts of fluctuation in molten steel surface level within ±10 mm, such measures as the use of a high responsibility stepping cylinder in the molten steel flow rate control mechanism or the selection of an appropriate control gain are required in addition to obtaining highly precise information about the molten steel surface level using an eddy current sensor for molten steel level control in a mold.

2-3. Third Aspect of the Invention

In the third aspect thereof, the invention is directed to a continuous casting method according to the first or second aspect of the invention, wherein the electromagnetic stirring of the molten steel in the mold is carried out while rotating the molten steel in a horizontal plane and the maximum rotational flow velocity of the molten steel is adjusted to a level within the range of 0.2-0.8 m/s.

The reason why a rotational flow in a horizontal plane is caused to form by electromagnetic stirring is that it is preferable from the viewpoint of suppressing the fluctuations in molten steel surface level to dispose an electromagnetic coil so that a tangential flow may be formed in a horizontal plane in carrying out electromagnetic stirring of the molten steel in the mold. The reason why the maximum value of the rotational flow velocity of the molten steel as produced by magnetic stirring is preferably within the range of 0.2-0.8 m/s is as follows. When the above-mentioned flow velocity is less than 0.2 m/s, it is difficult to obtain the effects of electromagnetic stirring, namely the effect of inhibiting the occurrence of center porosity by the promotion of formation of equiaxial crystals and the effect of allowing the solidified shell to grow uniformly through the control of the motion of the molten steel. On the other hand, when the above-mentioned flow velocity is in excess of 0.8 m/s, the fluctuations in molten steel surface level in the mold unfavorably increase to an excessive extent.

Here, the maximum value of the rotational flow velocity indicates the flow velocity of the molten steel at a site where the rotational flow velocity of the molten steel becomes maximum in the mold inside space region surrounded by the coil disposed for electromagnetic stirring.

2-4. Fourth Aspect of the Invention

In the fourth aspect thereof, the invention is directed to a continuous casting method according to any of the first to third aspects of the invention, wherein the adjustment of the casting speed is carried out in response to significant changes in contents in molten steel of at least three elements selected from among C, Si, Mn, P, S, Cr, Mo and Ni and a significant change in casting temperature.

The adjustment of the casting speed is preferably carried out taking into consideration the influences of the contents in molten steel of at least three elements selected from among C, Si, Mn, P, S, Cr, Mo and Ni, and of the casting temperature on the rate of solidification. The rate of solidification (more precisely, the rate of growth of the solidified shell) varies under the influences of the composition of the molten steel and the casting temperature. According to the present inventors' experience and investigations, it is preferable for predicting the rate of solidification of the billet with adequate accuracy that the contents in molten steel of at least three elements selected from among C, Si, Mn, P, S, Cr, Mo and Ni be taken into consideration with respect to the molten steel composition and the influence of the casting temperature be simultaneously taken into consideration.

The rate of solidification of the billet is influenced by the lowering of the equilibrium solidification temperature due to segregation of solute component elements and the changes in composition due to morphological changes of the oxide layer (scale) on the billet surface, and the extent of the influences varies depending on the operational conditions as well. The lowering of the solidification temperature can be predicted, for example, by numerical simulation of the solidification process taking the segregation of constituent elements into consideration. On the other hand, the change in rate of solidification as caused by the changes in constituent contents as resulting from the morphological changes of the oxide layer on the billet surface is difficult to predict by calculation and, therefore, it is necessary to derive the tendency based on examinations of a large number of billets. By abundantly accumulating the results of examinations as to the above relation and analyzing the solidification process by data fitting using those examinations results, it becomes possible to predict the rate of solidification.

From the viewpoint of bringing the billet appropriate in the solid phase ratio at the center into the cooling zone during the final period of solidification with good accuracy, the adjustment of the casting speed in the fourth aspect of the invention is preferably performed at each time when a significant change or changes in such effecting factors on the rate of solidification as the above-mentioned constituent contents and/or casting temperature are discerned. More specifically, the analytical values for every heat (every ladle) in the final stage of refining, for instance, are used as the constituent contents in the molten steel and the measured molten steel temperature value in the tundish per 30-50 tons (t) of steel cast, for instance, is used as the casting temperature, and the adjustment is preferably carried out at each time when a significant change or changes in effecting factors are recognized.

2-5. Fifth Aspect of the Invention

In the fifth aspect thereof, the invention is directed to a continuous casting method according to the first to fourth aspect of the invention, wherein the secondary cooling of the billet is finished at a site of at least 2 m upstream relative to the entrance to the cooling zone during the final period of solidification.

The reason why it is preferable to finish the secondary cooling of the billet at a site of at least 2 m upstream relative to the entrance to the cooling zone during the final period of solidification is that completing the secondary cooling at the above-mentioned site is desirable for making the billet surface temperature uniform and thereby increasing the effect of cooling during the final period of solidification. More preferably, the secondary cooling is completed at a site of at least 5 m upstream relative to the entrance to the cooling zone during the final period of solidification.

As explained hereinabove, it is possible to increase the effect of reducing center porosity by the cooling during the final period of solidification and stabilize the continuous casting operation by operating while optimizing various conditions in the steps of feeding of molten steel to the mold, secondary cooling, cooling during the final period of solidification, and billet cutting.

EXAMPLES

For confirming the effects of the continuous casting method of the invention, the following casting tests were carried out and the results were evaluated. The test conditions and test results are shown in Table 1, and the chemical compositions of the molten steel used in each casting test are shown in Table 2.

TABLE 1

| Test No. | A | B | C |
|---|---|---|---|
| Classification | Inventive example | Comparative example | Comparative example |
| Mold size (nominal) | 190 mmϕ | 190 mmϕ | 310 mmϕ |
| Billet cross sectional area | 280 $cm^2$ | 280 $cm^2$ | 750 $cm^2$ |
| Immersion nozzle | Cylindrical, single port Single port inner diameter 50 mmϕ | None | Cylindrical, single port Single port inner diameter 60 mmϕ |
| Sensor for molten steel level in mold | Eddy current type | γ-ray type | Eddy current type |
| Fluctuation in molten steel level in mold | ±4 mm | ±12 mm | ±3 mm |
| Electromagnetic stirring in mold | Horizontal stirring Maximum tangential flow velocity 0.4 m/s | Horizontal stirring Maximum tangential flow velocity 0.4 m/s | Horizontal stirring Maximum tangential flow velocity 0.5 m/s |
| Site of cooling zone during final period of solidification | Distance from meniscus = 27 m-33 m (length 6 m) | Distance from meniscus = 27 m-33 m (length 6 m) | Distance from meniscus = 27 m-33 m (length 6 m) |
| Casting speed adjustment | Adjustment considering molten steel chemical compositions, C, Si, Mn, P, S, Cr, Mo and Ni analyzed in final stage of refining in each heat. Adjustment based on molten steel temperature in tundish measured per 30 tons of steel cast. | Only one casting speed (no adjustment) selected according to typical chemical compositions of molten steel (C, Si, Mn, P, S, Cr) for each steel grade. | — |
| Density of cooling water during final period of solidification | 130 L/(min · $m^2$) | 130 L/(min · $m^2$) | 0 |
| Distance from end of secondary cooling to start of cooling during final period of solidification | 19 m | 19 m | — |
| Specific amount of secondary cooling water | 0.4 L/kg-steel | 0.4 L/kg-steel | 0.6 L/kg-steel |
| Billet surface temperature at entrance to cooling zone during final period of solidification | 1100° C. | 1100° C. | — |
| Distance from exit of cooling zone during final period of solidification to site of completion of billet cutting | 3.5 m | 3.5 m | — |
| Rate of inner surface defects in seamless pipe | 0.1% | 7.0% | — |

TABLE 2

| Chemical composition of steel (% by mass, the balance being Fe and impurities) | | | | | | | | |
|---|---|---|---|---|---|---|---|---|
| C | Si | Mn | P | S | Cr | Mo | Ni | sol. Al |
| 0.12 −0.14 | 0.28 −0.32 | 0.55 −0.63 | 0.008 −0.014 | 0.002 −0.006 | 1.07 −1.11 | 0.31 −0.37 | 0.20 −0.24 | 0.003 −0.006 |

Since the actual molten steel composition varied from heat to heat, so that the range of fluctuation in each chemical composition of steel is given in Table 2.

Test No. A is a test for an inventive example and, since all the requirements prescribed herein are satisfied, it is a test in which billets with suppressed center porosity at the billet center can be obtained.

As for the casting conditions, the casting temperature, namely the degree of superheat of molten steel (molten steel temperature in tundish−liquidus temperature of steel), was 35-60° C., and the casting speed in a steady-state casting was 2.7 m/min on average. In Test No. A, the casting speed was adjusted within the range of +0.1 m/min with the accuracy of 0.01 m/min according to the molten steel composition and casting temperature so that the region in which the solid phase ratio at the billet center was from 0.3 to 0.99 might be included in the cooling zone during the final period of solidification.

As a result, in Test No. A, the occurrence of porosity at the billet center could be reliably reduced under stable operating conditions and the inner quality of the billet could be improved highly reliably. Seamless steel pipes were produced using the thus-cast billets and subjected to inner surface quality examination; the result was superb, namely the rate of inner surface defects was 0.1%.

The rate of inner surface defects was determined by dividing the number of tubes judged "nonconforming" under visual inspection for pipe inside surface by the total number of pipes subjected to visual inspection and converting the quotient to the corresponding percentage.

On the contrary, Test No. B is a test for a comparative example outside the ranges prescribed in the first aspect of the invention. In Test No. B, the open molten steel feeding method was employed without using any immersion nozzle and therefore the eddy current sensor for molten steel level control in a mold could not be applied. As a result, the fluctuations in surface level of molten steel were large and the growth of the solidified shell was unstable. Further, in Test No. B, the casting speed was merely predetermined for each steel grades, so that the influences of the fluctuations in molten steel composition and/or in casting temperature for each heat could not be reflected in the adjustment of the casting speed.

As a result, in Test No. B, the effect for reducing the occurrence of center porosity at the billet center was lessened due to the above-mentioned unstable and unreliable factors and, in addition, the operation became unstable and breakout of the solidified shell occurred frequently. Further, seamless pipes were produced using the thus-cast billets and subjected to inner surface quality examination; the results were inferior, namely the rate of inner surface defects was 7%.

Test No. C is a test for a comparative example in which the cross sectional area was too big to satisfy the relevant requirement prescribed herein and which is therefore unfit for carrying out the continuous casting method according to the invention. In Test No. C, the art of reducing the occurrence of porosity owing to the cooling during the final period of solidification was not applied, so that massive center porosity occurred at the billet center.

INDUSTRIAL APPLICABILITY

According to the method of the invention for continuously casting a billet with a small cross section, the occurrence of porosity at the billet center can be reduced stably and the reliability in improving the billet inner quality can be increased by pouring molten steel into a mold using a cylindrical immersion nozzle with a single port, measuring the molten steel surface level in the mold using an eddy current sensor and controlling the molten steel surface level based on the thus-measured values, adjusting the motion of molten steel in the mold by electromagnetic stirring, prescribing the site and length of the cooling zone during the final period of solidification, adjusting the casting speed so that the region in which the solid phase ratio at the billet center is within a specified range may be included in the cooling zone during the final period of solidification and, further, optimizing the specific amount of cooling water in the secondary billet cooling zone, the billet surface temperature at the entrance to the cooling zone during the final period of solidification and the density of cooling water in the cooling zone during the final period of solidification, among others.

Therefore, the method of the invention serves as a technology capable of being widely applied as a continuous casting method by which the effect of reducing the occurrence of center porosity owing to cooling during the final period of solidification can be increased and the casting operation can be stabilized as a result of carrying out the operation while optimizing various operational conditions through the steps of molten steel feeding to the mold, secondary cooling, cooling during the final period of solidification, and billet cutting.

What is claimed is:

1. A method for continuously casting a billet with a small cross section in which the billet has a cross sectional area of not more than 500 $cm^2$ and a cylindrical immersion nozzle with a single port of not less than 40 mm in inner diameter is used for pouring a molten steel into a mold, wherein:

a surface level of molten steel is measured using an eddy current sensor for molten steel level control in a mold and the molten steel level is controlled based on the thus-measured value, and motion of molten steel in the mold is adjusted by applying electromagnetic stirring;

a cooling zone during a final period of solidification, which is 3-8 m in length and continuous in the direction of casting, is provided in a region ranging from the meniscus of molten steel in the mold to an area that is 15-45 m away therefrom in the direction of casting, and a casting speed is adjusted so that a region in which the solid phase ratio at the billet center is 0.3-0.99 may be included in the cooling zone during the final period of solidification;

the billet is cooled in a secondary cooling zone, located on a side upstream relative to the cooling zone during the final period of solidification, with a cooling water in a specific amount of 0.1-0.8 liter (L)/kg-steel to thereby adjust a billet surface temperature at the entrance to the cooling zone during the final period of solidification to 900-1200° C.;

the billet is cooled in the cooling zone during the final period of solidification with the cooling water at a density of 20-300 liters (L)/(min·$m^2$) on the billet surface; and the billet is cut at a site of at least 1 m downstream relative to the exit of the cooling zone during the final period of solidification.

2. The continuous casting method according to claim 1, wherein fluctuations in surface level of molten steel in the mold are controlled within ±10 mm.

3. The continuous casting method according to claim 2, wherein the electromagnetic stirring is carried out while the molten steel in the mold is rotated in a horizontal plane and the maximum value of the tangential flow velocity of molten steel is adjusted within the range of 0.2-0.8 m/s.

4. The continuous casting method according to claim 2, wherein the adjustment of a casting speed is carried out in response to significant changes in contents in the molten steel of at least three elements selected from among C, Si, Mn, P, S, Cr, Mo and Ni and a significant change in casting temperature.

5. The continuous casting method according to claim 2, wherein the secondary cooling of the billet is terminated at a site of at least 2 m upstream relative to the entrance to the cooling zone during the final period of solidification.

6. The continuous casting method according to claim 1, wherein the electromagnetic stirring is carried out while the molten steel in the mold is rotated in a horizontal plane and the maximum value of the tangential flow velocity of molten steel is adjusted within the range of 0.2-0.8 m/s.

7. The continuous casting method according to claim 6, wherein the adjustment of a casting speed is carried out in response to significant changes in contents in the molten steel of at least three elements selected from among C, Si, Mn, P, S, Cr, Mo and Ni and a significant change in casting temperature.

8. The continuous casting method according to claim 6, wherein the secondary cooling of the billet is terminated at a site at least 2 m upstream relative to the entrance to the cooling zone during the final period of solidification.

9. The continuous casting method according to claim 1, wherein the adjustment of a casting speed is carried out in response to significant changes in contents in the molten steel of at least three elements selected from among C, Si, Mn, P, S, Cr, Mo and Ni and a significant change in casting temperature.

10. The continuous casting method according to claim 9, wherein the secondary cooling of the billet is terminated at a site at least 2 m upstream relative to the entrance to the cooling zone during the final period of solidification.

11. The continuous casting method according to claim 1, wherein the secondary cooling of the billet is terminated at a site of at least 2 m upstream relative to the entrance to the cooling zone during the final period of solidification.

* * * * *